US009058939B2

(12) United States Patent
Mittelstadt et al.

(10) Patent No.: US 9,058,939 B2
(45) Date of Patent: Jun. 16, 2015

(54) CONFIGURATION OF AN ARC RUNNER FOR A MINIATURE CIRCUIT BREAKER

(75) Inventors: Chad R. Mittelstadt, Cedar Rapids, IA (US); Jeff Kaufman, West Liberty, IA (US)

(73) Assignee: SCHNEIDER ELECTRIC USA, INC., Palatine, IL (US)

( * ) Notice: Subject to any disclaimer, the term of this patent is extended or adjusted under 35 U.S.C. 154(b) by 865 days.

(21) Appl. No.: 13/171,883

(22) Filed: Jun. 29, 2011

(65) Prior Publication Data

US 2013/0001201 A1 Jan. 3, 2013

(51) Int. Cl.

| | |
|---|---|
| ***H01H 9/46*** | (2006.01) |
| ***H01H 73/18*** | (2006.01) |
| *H01H 33/20* | (2006.01) |

(52) U.S. Cl.

CPC ..... *H01H 9/46* (2013.01); *H01H 33/20* (2013.01); *H01H 73/18* (2013.01)

(58) Field of Classification Search

CPC ..... H01H 9/30; H01H 9/46; H01H 73/00; H01H 73/18

USPC ..... 218/40, 15–22, 148, 149; 335/201, 202, 335/167–176

See application file for complete search history.

(56) References Cited

U.S. PATENT DOCUMENTS

| | | | | |
|---|---|---|---|---|
| 2,471,608 | A | 5/1949 | Caswell | |
| 3,081,386 | A | 3/1963 | Koenig et al. | |
| 4,546,336 | A | 10/1985 | Petrie et al. | |
| 4,871,889 | A | 10/1989 | Leone et al. | |
| 5,493,091 | A | 2/1996 | Devautour et al. | |
| 5,608,198 | A | 3/1997 | Clark et al. | |
| 5,847,913 | A | 12/1998 | Turner et al. | |
| 5,973,280 | A * | 10/1999 | Gula et al. | 200/400 |
| 6,689,979 | B1 * | 2/2004 | Bach et al. | 218/40 |
| 7,067,758 | B2 | 6/2006 | Kruschke | |
| 2010/0288732 | A1 | 11/2010 | Heins et al. | |

FOREIGN PATENT DOCUMENTS

| | | | |
|---|---|---|---|
| DE | 102006026064 | A1 | 12/2007 |
| WO | 93/22784 | A1 | 11/1993 |

OTHER PUBLICATIONS

International Search Report corresponding to co-pending International Patent Application Serial No. PCT/US2012/043219, European Patent Office, dated Sep. 21, 2012 ( 4 pages).

International Written Opinion corresponding to co-pending International Patent Application Serial No. PCT/US2012/043219, European Patent Office, dated Sep. 21, 2012; (6 pages).

* cited by examiner

*Primary Examiner* — Amy Cohen Johnson
*Assistant Examiner* — Marina Fishman
(74) *Attorney, Agent, or Firm* — Locke Lord LLP

(57) ABSTRACT

An arc runner configured to provide a substantially constant separation between a side surface of a conductive contact carrier and an arc discharge surface of the arc runner during an initial portion of a separation of two contacts. The arc discharge surface is preferably a flat surface oriented perpendicular to an axis of rotation of one contact away from the other. The conductive contact carrier having the side surface is configured to allow the arc runner to repeatedly travel along its side without mechanical interference during repeated openings and closings of the contacts. During the initial portion of the separation of the contacts, an electrical arc generated between the contacts during the separation is desirably transferred off of the contacts to the arc discharge surface after the separation between the contacts exceeds the distance between the side surface and the arc discharge surface.

19 Claims, 9 Drawing Sheets

CONFIGURATION OF AN ARC RUNNER FOR A MINIATURE CIRCUIT BREAKER

FIELD OF THE INVENTION

The present disclosure relates generally to electrical circuit protection devices, and, more particularly, to an apparatus incorporating a conductive discharge surface to prevent degradation of a fixed contact and a moveable contact respectively mounted to a fixed conductive part and a moveable conductive part during a separation of the contacts that generates an electrical arc.

BACKGROUND

Circuit protection devices such as molded case circuit breakers are utilized to control and regulate current supplied to circuits. The circuit protection devices generally incorporate tripping mechanisms to open two contacts within the device upon the occurrence of a fault condition. The trip mechanism can be magnetically or thermally activated at pre-determined current levels. Circuit protection devices also generally include handles to both reset the protection device following a fault, or to manually open the contacts independent of the occurrence of a fault. In either case, opening the energized contacts generally generates an electrical arc due to the potential difference between the contacts immediately following their separation. For sufficient potential differences, gasses between the contacts are ionized to allow electrical energy (i.e., current) to continue flowing between the contacts via an electrical arc.

If not accounted for, electrical arcs can damage aspects within the circuit protection device, such as the tripping mechanism, springs for biasing components within the circuit breaker, or degrading the contacts themselves. The contacts can be degraded by oxidization. For example, conductive metallic contacts subjected to electrical arcs can gradually experience an increase in resistance and become less efficient conductive conveyors of electrical energy. Over time, the decreased efficiency of the contacts can lead to wasted energy, increased heat generation, and inadequate performance of the circuit protection device.

Some devices implement electrical arc protection by adjusting the outgassing of vent gasses following an arc event so as to influence the arc away from components desired to be protected. Other devices having high current flows utilize magnetic fields generated by current flowing through the device to direct the electrical arc away from components desired to be protected. Some devices also utilize sacrificial conductive features positioned near the contacts and aligned to provide an arc discharge path that directs the arc away from components desired to be protected.

BRIEF SUMMARY

Disclosed herein is an arc runner which is aligned to maintain a constant separation from a side surface of one of the contacts during an initial portion of a separation of the contacts. An electrical arc generated during the separation of the two contacts is directed through the side surface to an arc discharge surface of the arc runner after the distance between the two contacts exceeds the distance maintained between the side surface and the arc runner during the initial separation. The arc runner is aligned with the arc discharge surface parallel to the side surface and perpendicular to an axis of rotation of the contacts. The arc discharge surface overlaps the side surface while the contacts are closed, and a portion of the arc discharge surface instantaneously maintains the constant separation during the initial portion of the separation of the contacts. The constant separation from the arc discharge surface is maintained while the distance between the contacts exceeds the constant separation.

The contacts can each be mounted to a fixed contact carrier and moveable contact carrier, respectively. The arc runner can be integrally formed with, or securely conductively attached to, one or the other of the fixed or moveable conductive carriers. Where the moveable contact carrier is configured to rotationally separate the one contact from the other, the arc discharge surface can be substantially flat and is aligned in a plane perpendicular from an axis of rotation of the moveable contact carrier. By directing the electrical arc off of the contacts to the arc discharge surface of the arc runner, degradation to the contacts and other aspects of the electrical protection device is prevented.

The foregoing and additional aspects and implementations of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

DETAILED DESCRIPTION

Figure 1:
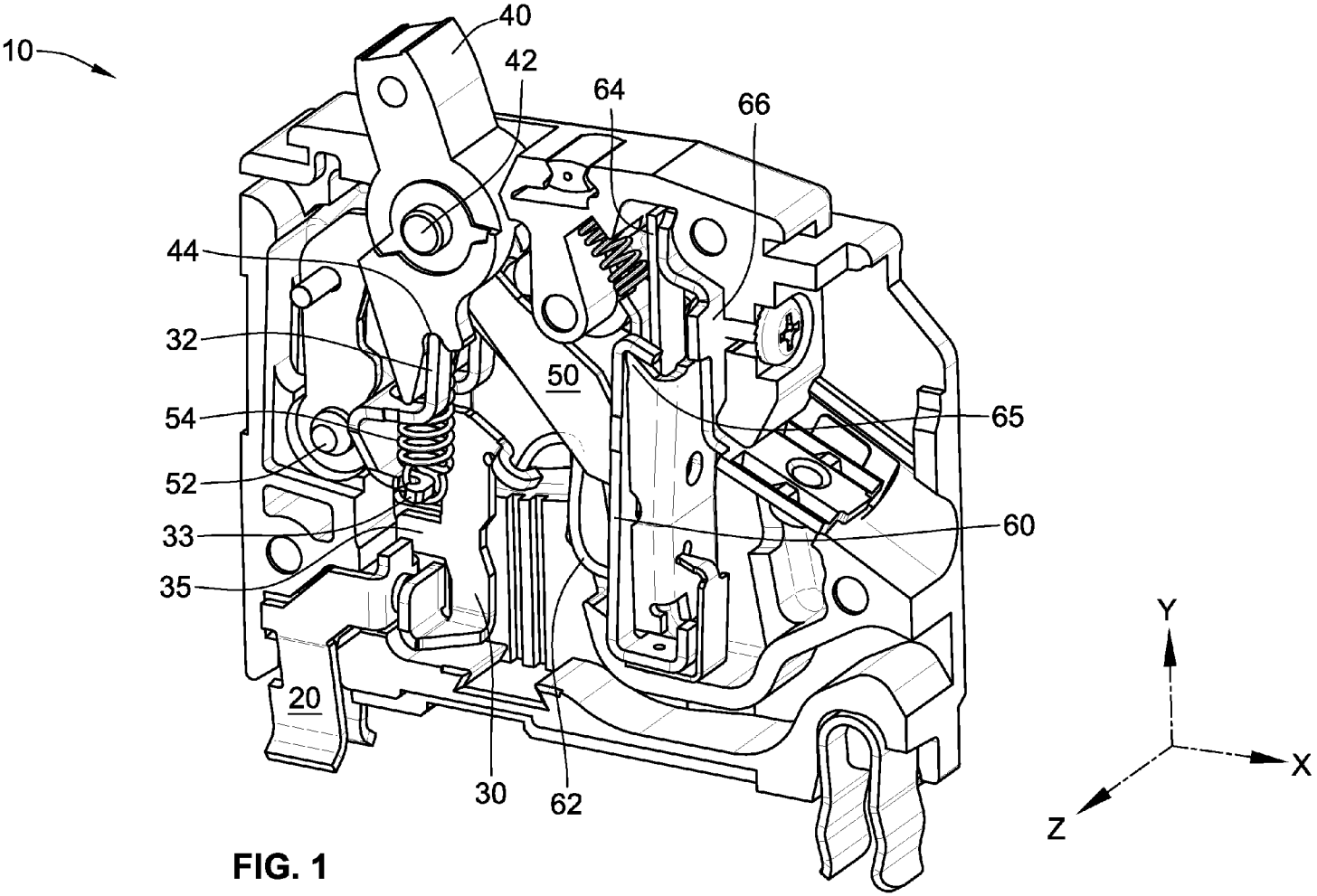
FIG. 1 illustrates an aspect of the circuit breaker with internal components of the circuit breaker visible.
Figure 2A:
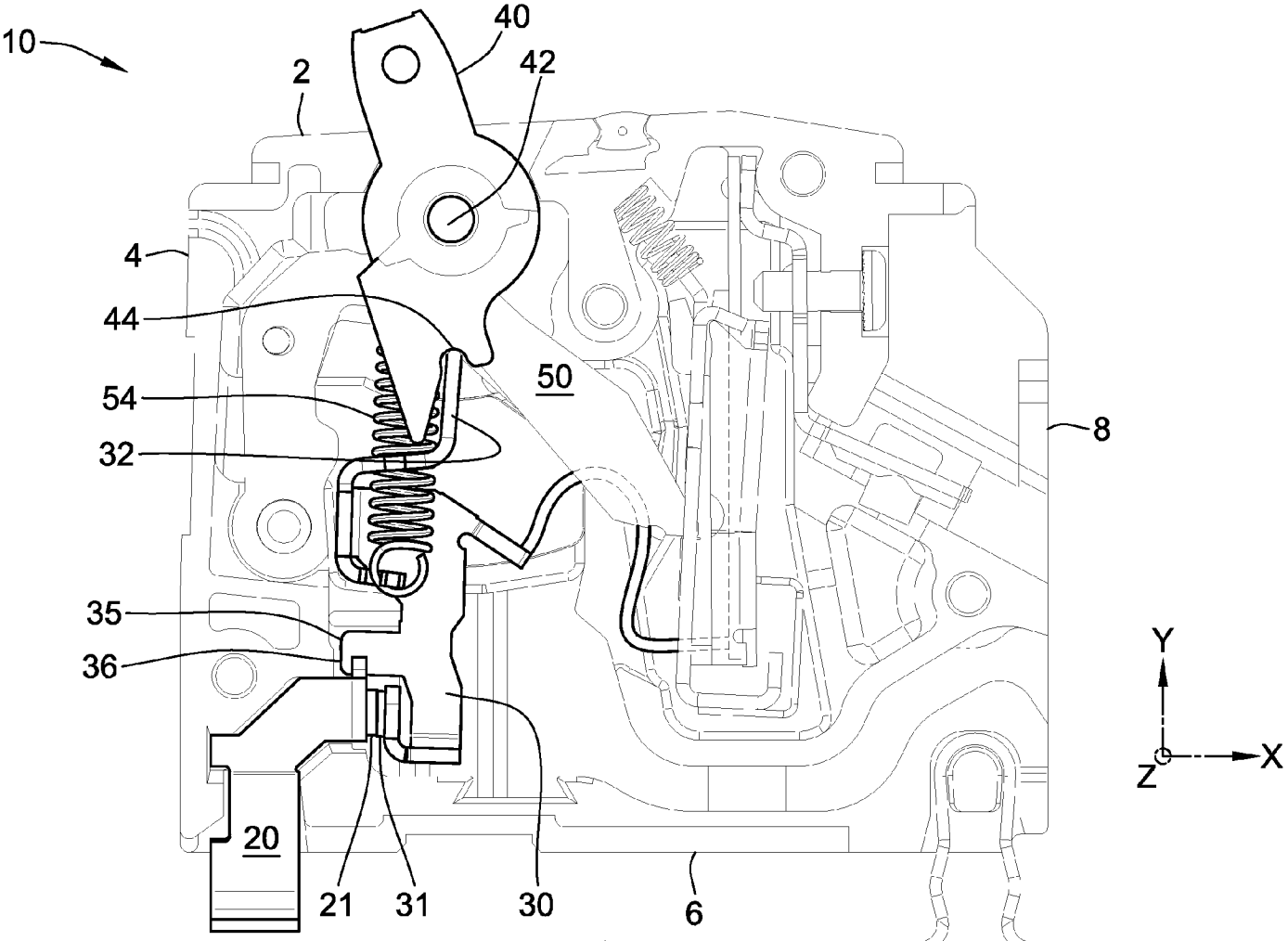
FIG. 2A is a side view of the circuit breaker shown in FIG. 1 where the handle is the on position ("closed position").
Figure 2B:
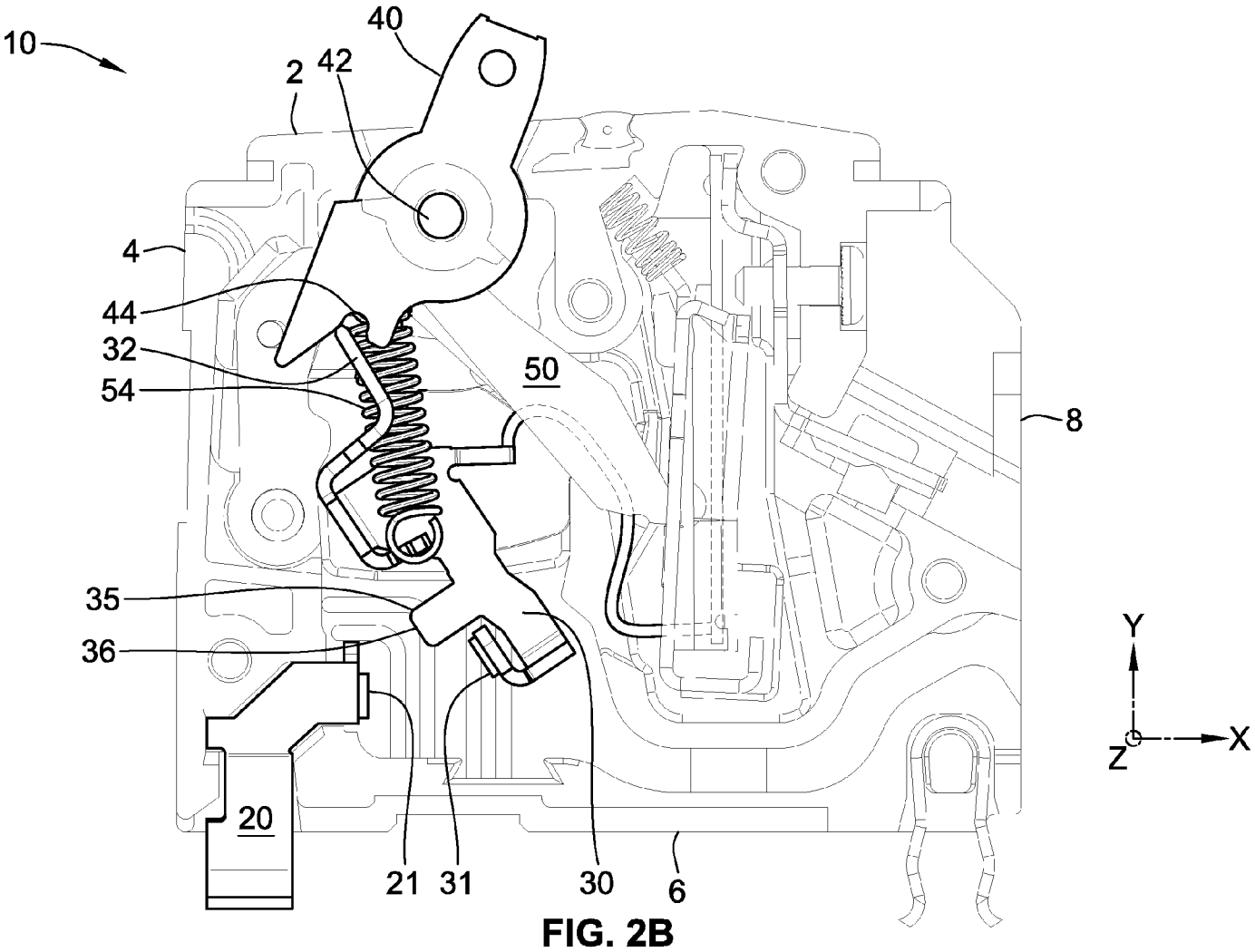
FIG. 2B is a side view of the circuit breaker where the handle is in the off position ("open position").

FIGS. 1, 2A and 2B illustrate a circuit breaker 10 designed to prevent degradation of contacts 21, 31 due to arc energy generated during a circuit interruption. The circuit breaker 10 incorporates an arc runner 35 integrally formed with a moveable contact carrier 30 to transfer arc energy from between the contacts 21, 31 to the arc runner 35 during a rotational separation of the moveable contact carrier 30 from the fixed contact ("stationary contact") 20. The arc runner 35 and its configuration which allow for the protection of the contacts 21, 31 and/or other components within the circuit breaker 10 is described further herein.

FIG. 1 illustrates an aspect of the circuit breaker 10 with internal components of the circuit breaker 10 visible. The circuit breaker 10 includes a tripping mechanism, a fixed contact carrier ("stationary contact carrier" or "jaw") 20, a moveable contact carrier ("blade") 30, an arc runner 35, and a handle 40. The fixed contact carrier 20 has a fixed contact 21 mounted thereon, and the moveable contact carrier 30 has a moveable contact 31 mounted thereon. The fixed contact 20 includes a line terminal configured to be coupled to a bus bar to receive electrical energy. For example, the line terminal can be energized via a 50 Hertz or 60 Hertz alternating current electrical supply line. In normal operation, while the circuit breaker 10 remains in a closed position (such as shown in FIG. 2A), electrical energy (e.g., current) is conveyed from the fixed contact carrier 20 to the moveable contact carrier 30 via the contacts 21, 31, which abut one another in the closed position to conductively convey electrical energy. Electrical energy is then conveyed through the moveable contact carrier 30 to a flexible conductor (e.g., "pigtail" connector) 62 that is electrically coupled to both the moveable contact carrier 30 and a bimetallic strip 64. The bimetallic strip 64 passes through a magnetic armature 60 and is electrically coupled to a load terminal 66. Thus, while the circuit breaker 10 remains in the closed position, a current path through the circuit breaker 10 flows from a line terminal of the fixed contact carrier 20 to the load terminal 66. The circuit breaker 10 is generally enclosed by an insulating material to house and support the internal components of the circuit breaker 10. For example, the circuit breaker 10 can be a molded case circuit breaker.

The flow of electrical energy can be interrupted in response to urging the handle 40 from the on position (FIG. 2A) to the off position (FIG. 2B) or in response to an occurrence of a fault condition, such as a magnetic type or thermal-type overcurrent condition. Urging the handle to the off position from the on position causes the moveable contact carrier 30 to move from a closed position (FIG. 2A) to an open position (FIG. 2B) so as to rotationally separate the moveable contact 31 from the fixed contact 21. Similarly, in response to a fault condition in the electrical circuit coupled to the circuit breaker 10, the tripping mechanism causes the moveable contact carrier 30 to rotate from the closed position to the open position. In both cases, the separation of the contacts 21, 31 while energized causes an electrical arc between the contacts 21, 31. The arc runner 35 is advantageously aligned to reduce degradation of the contacts 21, 31 due to the occurrence of electrical arcs between the contacts 21, 31.

The operation of the trip mechanism to separate the contacts 21, 31 in response to the occurrence of a magnetic or thermal fault is described next herein. In a magnetic trip, the tripping mechanism operates in response to the current flow through the circuit breaker reaching a specified level. The elevated current level causes a high magnetic field which draws the magnetic armature 60 toward a yoke surrounding the bimetallic strip 64. The magnetic armature thus rotates counter-clock wise about an armature pivot 65 of the yoke. The counter-clockwise rotation of the armature 60 causes a lever 50 to release from a mechanical engagement with a latch window (not visible) formed in the armature 60. The released lever 50 is urged by the toggle spring 54 to rotate clockwise about a lever post 52. One end of the toggle spring 54 is connected to a toggle spring hook 33 of the moveable contact carrier 30, while the other is connected to a carrier hook (not visible) of the lever 50.

As the lever 50 and its carrier hook rotate clockwise about the lever post 52, the toggle spring 54 rotates clockwise about the toggle spring hook 33. Rotation of the toggle spring 54 beyond its over-center position causes the movable contact carrier 30 to rotate counter-clockwise to the open position (FIG. 2B). The over-center position of the toggle spring 54 is defined by a line extending between the carrier hook and a pivot 42 of the handle 40. As the movable contact carrier 30 rotates to the open position, the handle 40 is rotated clockwise about its post 42 to an off position by virtue of the engagement of the contact carrier leg 32 with a pivot notch 44 formed by the handle 40.

In a thermal trip the tripping mechanism operates in response to the current in the circuit breaker 10 reaching a predetermined percentage (e.g., 135 percent) of the rated current for a period of time to be determined by calibration of the circuit breaker 10. This elevated current level causes direct heating of the bimetallic strip 64 (FIG. 1), which results in the bending of the bimetallic strip 64. The bimetallic strip 64 is composed of two dissimilar thermostat materials which are laminated or bonded together and which expand at different rates due to temperature increases, thereby causing the bimetallic strip 64 to bend as a function of its temperature. When the thermal-type overcurrent condition occurs, the bimetallic strip 64 heats up and flexes counter-clockwise about its connection to the load terminal 66. The yoke surrounding the bimetallic strip 64 and connected thereto carries the magnetic armature 60 with the bending bimetallic strip 64. The deflected bimetallic strip 64 thereby causes the armature 60 to release its engagement of the lever 50. As described above in connection with magnetic tripping, the release of the lever 50 allows the toggle spring 54 to travel beyond its over-center position, causing the movable contact carrier 30 to rotate counter-clockwise to the open position (FIG. 2B).

FIG. 2A is a side view of the circuit breaker 10 shown in FIG. 1 where the handle 40 is the on position ("closed position"). FIG. 2B is a side view of the circuit breaker 10 where the handle 40 is in the off position ("open position"). Moving the handle 40 to the off position (FIG. 2B) can be accomplished by manually urging the portion of the handle 40 extending through the top side 2 of the circuit breaker 10. For example, the on position of the handle 40 can be indicated by the handle 40 extending through the top side 2 generally toward the bus bar end 4 opposite the load terminal end 8, and the off position of the handle 40 can be indicated by the handle 40 extending through the top side 2 toward the load terminal end 8 of the circuit breaker 10. When the exposed portion of the handle 40 is urged toward the load terminal end 8, the handle 40 rotates clockwise about its post 42, which causes the pivot notch 44 of the handle 40 to also rotate clockwise about the post 42. The clockwise rotation of the pivot notch 44 urges the leg 32 of the moveable contact carrier 30 toward the bus bar end 4 of the circuit breaker 10. With the displacement of the leg 32 of the moveable contact carrier 30, the force of the toggle spring 54 on the moveable contact carrier 30 provides a torque urging the moveable contact carrier 30 to rotate generally counter-clockwise. During the rotation, the moveable contact 31 is separated from the fixed contact 21, as shown in FIG. 2B.

The handle 40 can be manually re-set by urging the handle back toward the bus bar end 4 of the circuit breaker 10 thereby rotating the handle 40 counter-clockwise about the post 42. The notch pivot 44 then engages the leg 32 of the moveable contact carrier 30 to urge the leg 32 in the direction of the load terminal end 8. The combination of the engagement between the leg 32 and the notch pivot 44 and the force exerted by the toggle spring 54 on the moveable contact carrier 30 urges the moveable contact carrier 30 to rotate generally clockwise until stopping when the moveable contact 31 abuts the fixed contact 21. The on position (or "closed position") is shown, for example by FIG. 2A.

Figure 3A:
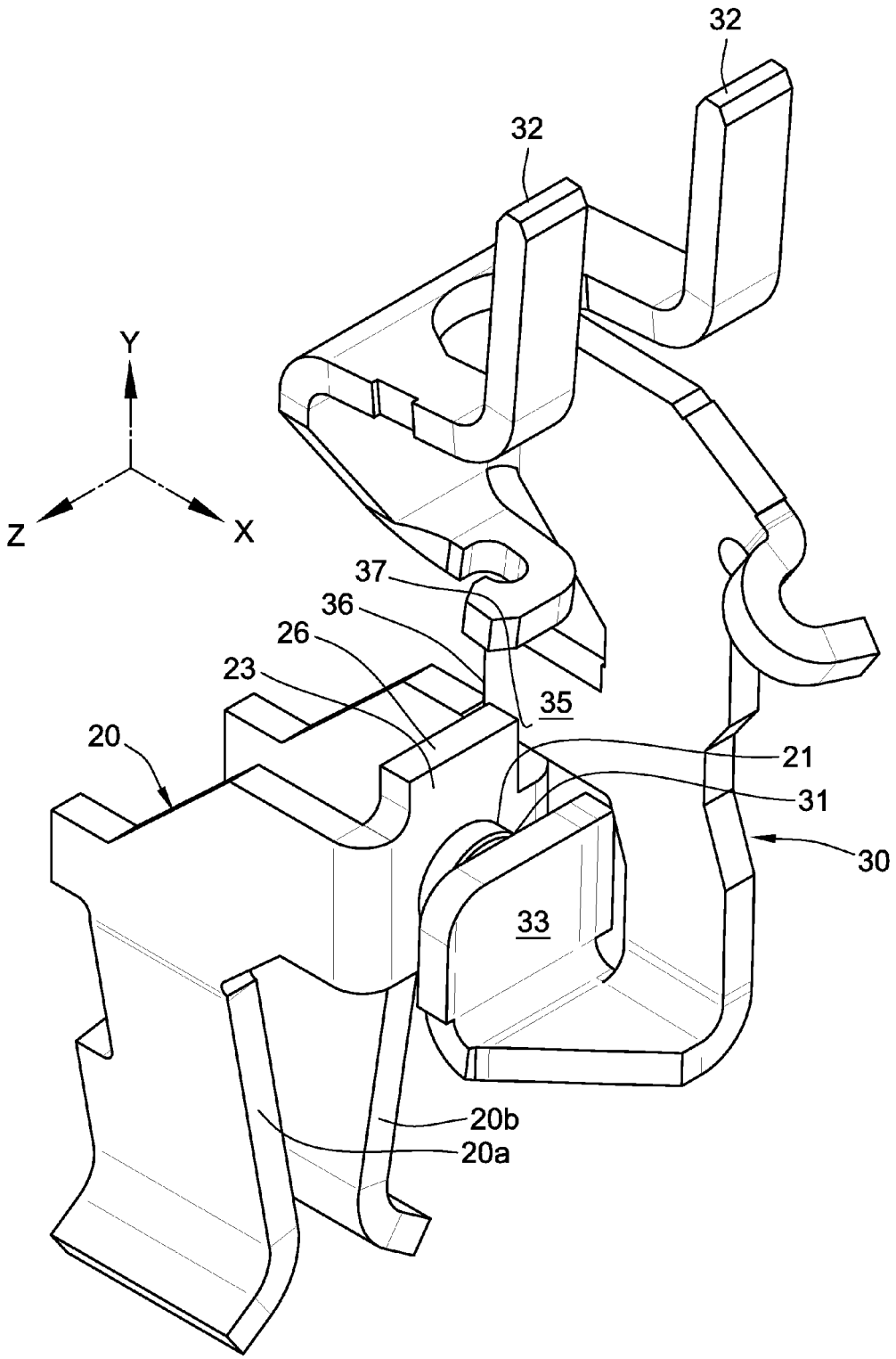
FIGS. 3A and 3B illustrate enlarged aspects view of the fixed contact carrier and the moveable contact carrier.
Figure 3B:
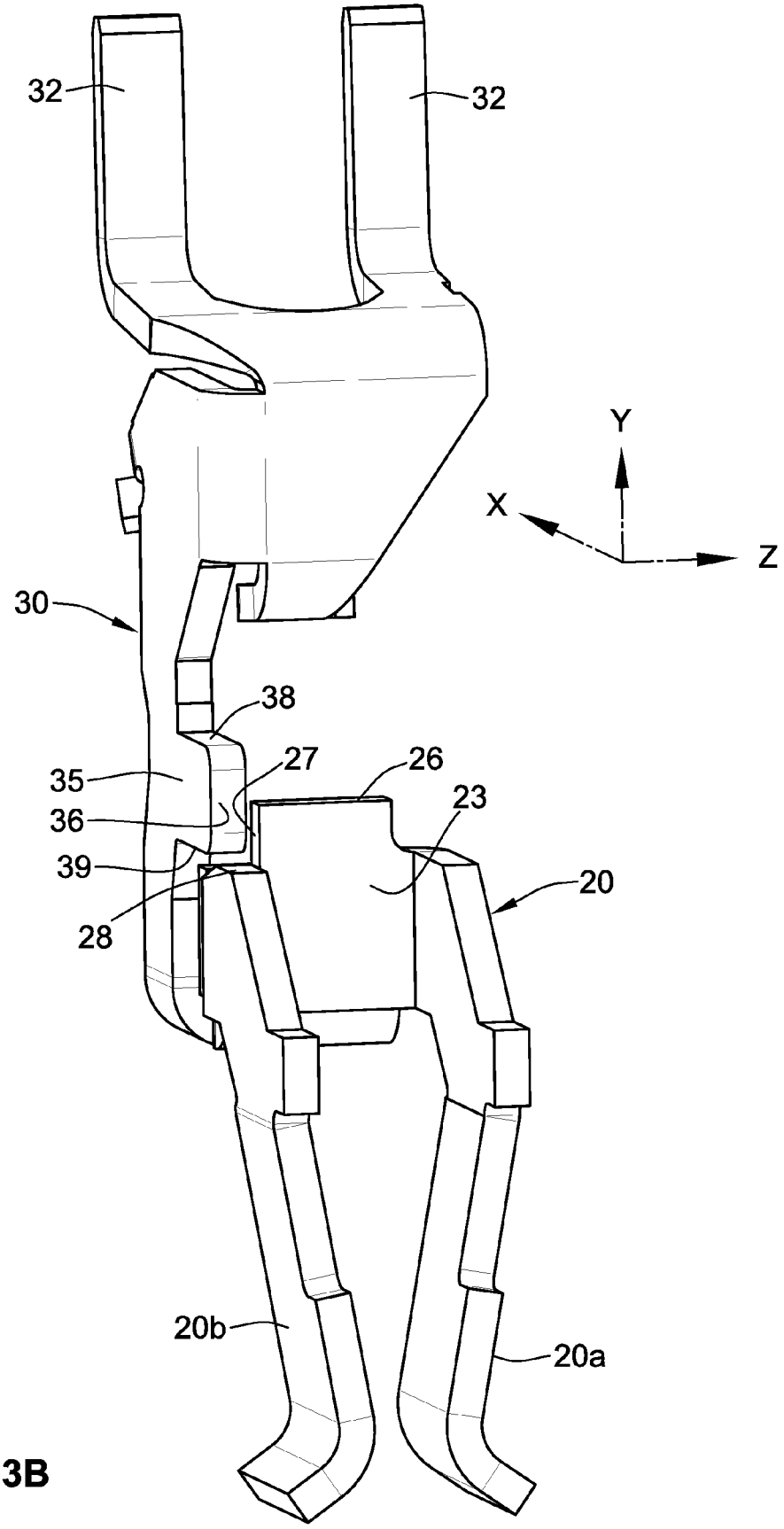
Figure 3C:
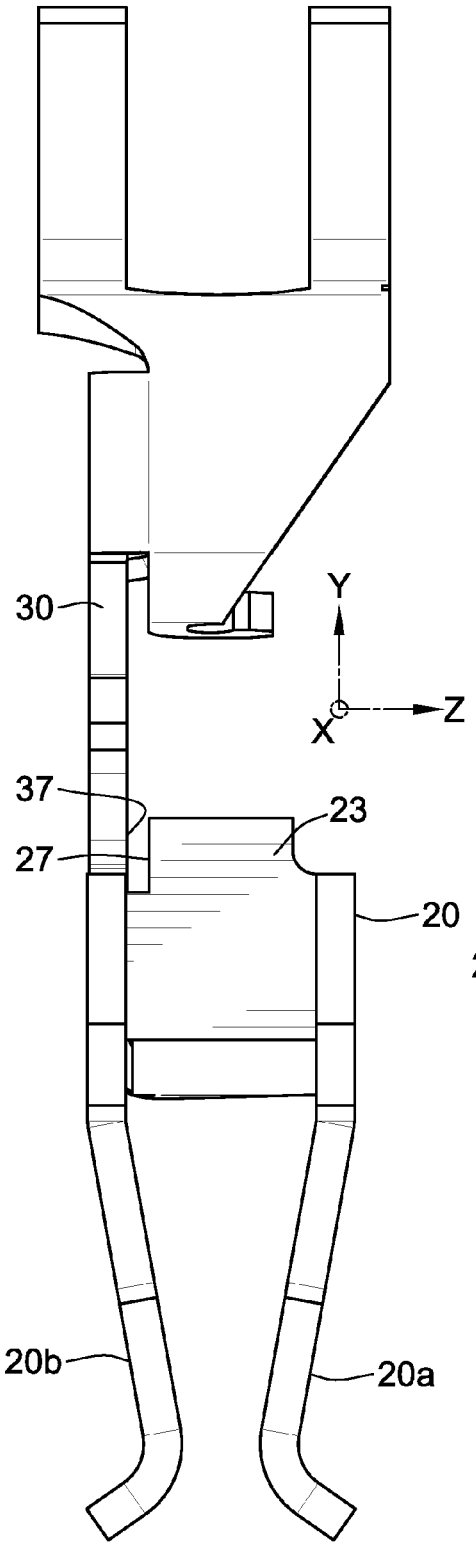
FIG. 3C illustrates a rear view (from the perspective of the bus bar end) of the fixed contact carrier and the moveable contact carrier.
Figure 3D:
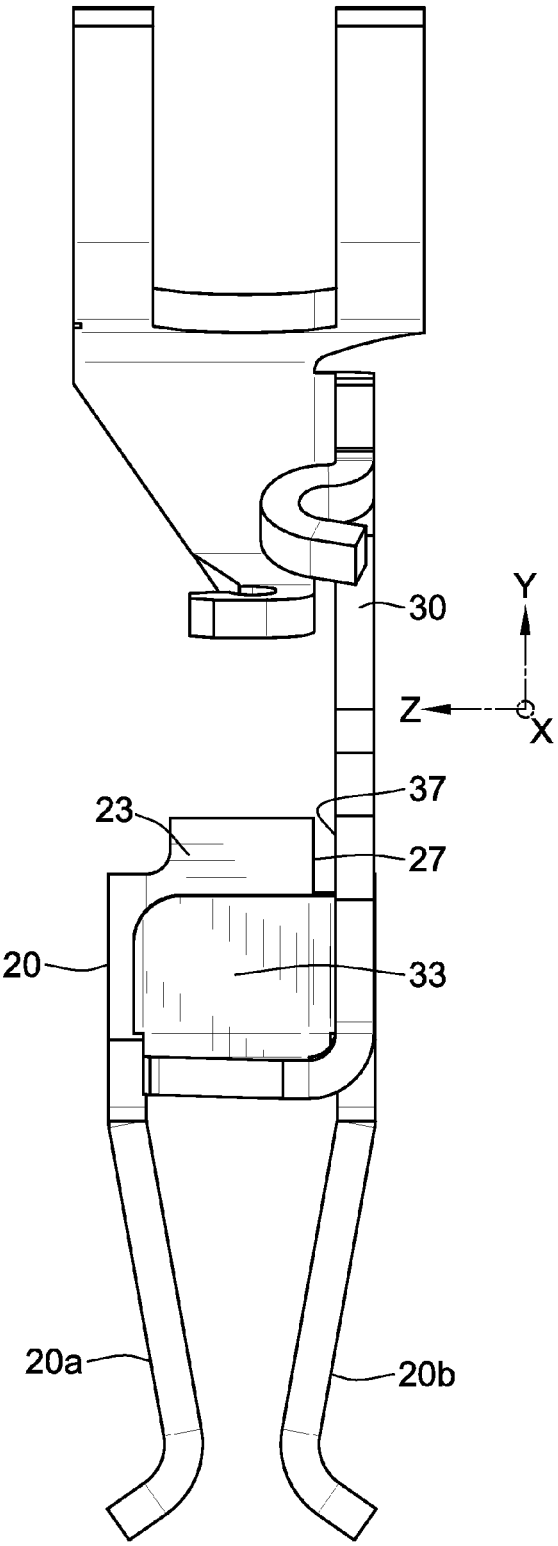
FIG. 3D illustrates a front view (from the perspective of the load terminal end) of the fixed contact carrier and the moveable contact carrier.

FIGS. 3A and 3B illustrate enlarged aspects view of the fixed contact carrier 20 and the moveable contact carrier 30. FIG. 3C illustrates a rear view (from the perspective of the bus bar end 4) of the fixed contact carrier 20 and the moveable contact carrier 30. FIG. 3D illustrates a front view (from the perspective of the load terminal end 8) of the fixed contact carrier 20 and the moveable contact carrier 30. In FIGS. 3A-3D, the fixed contact carrier 20 and the moveable contact carrier 30 are arranged in the closed position such that the fixed contact 21 abuts the moveable contact 31.

As shown in FIG. 3A, the moveable contact carrier 30 includes a moveable face 33 oriented in a plane perpendicular to the body of the moveable contact carrier 30. The moveable face 33 provides a mounting location for the moveable contact 31, which is generally round and includes a flat surface for abutting the fixed contact 21. The moveable contact carrier 30 also includes the legs 32, which interface with the notch pivot 44 formed in the handle 40 to allow for re-positioning the moveable contact carrier 30 responsive to the motion of the handle 40 as described above in connection with FIGS. 2A and 2B. In particular, a line connecting the ends of the two legs 32 generally defines an orientation of an axis of rotation of the moveable contact carrier 30. On FIGS. 1 to 3D, the direction of the axis of rotation is indicated as the z-axis.

As shown in FIG. 3B, the fixed contact carrier 20 includes a first leg 20*a* and a second leg 20*b*, which are inwardly biased with respect to a center plane of the fixed contact carrier 20. The center plane of the fixed contact carrier extends along the x-axis and the y-axis and bisects the gap between the legs 20*a*, 20*b* without piercing either, and bisects the fixed contact 21. The first leg 20*a* and the second leg 20*b* are each biased toward the center plane thus defined such that the legs 20*a*, 20*b* can be mounted to a bus bar to receive electrical energy, such as a bus bar in an electrical breaker box for supplying circuits each separately protected by a circuit protection device such as the circuit breaker 10. The fixed contact carrier 20 also includes a fixed face 23 generally co-planar with the fixed contact 21. The fixed contact 21 is securely mounted to the fixed face 23. The fixed face 23 has a top surface 26 defining a top extent of the fixed face 23. The fixed face 23 also includes a side surface 27 defining at least a portion of a side of the fixed face 23. The side surface 27 is generally oriented perpendicular to the fixed contact 21 such that the side surface 27 is in a plane parallel to a plane of the discharge surface 37 of the arc runner 35.

With reference to the unit mutually orthogonal Cartesian coordinate vectors illustrated in FIGS. 1 through 3D (labeled as x, y, z), the side surface 27 is a surface extending in a plane having dimensions in the x-axis and the y-axis. As shown in FIG. 3B, the side surface 27 extends from the top surface 26 to a top shoulder 28 of the second leg 20*b* in the y-direction, while the side surface 26 extends between the opposing front and back surfaces of the fixed face 23 in the x-direction. The side surface 27 is generally a flat, smooth surface along a side portion of the fixed face 23, however the side surface 27 can also be rounded or curved according to aspects of the present disclosure. As will be further described herein, the side surface 27 of the fixed face 23 provides a conductive feature for conveying electrical arcs to the arc discharge surface 37 of the arc runner 35. The conductive feature (such as the side surface 27) is configured to allow for an electrical arc generated during a separation of the energized contacts 21, 31 to be transferred from the contacts 21, 31 to the space between the arc discharge surface 37 and the side surface 27. In implementations, the dimensional extent (e.g., area) of the side surface 27 can be selected to provide adequate conductive surface through which electrical arcs can discharge to the arc discharge surface 37 based on expected electrical energy of the arcs.

The fixed contact carrier 20 is generally configured to allow the arc runner 35 to be received adjacent to the side surface 27 while the moveable contact carrier 30 is in the closed position without aspects of the fixed contact carrier 20 mechanically interfering with the arc runner 35. For example, with further reference to the center plane of the fixed contact carrier 20 previously described, it is noted that the fixed face 23 is asymmetric about the center plane to allow for clearance of the arc runner 35 while in the closed position. The asymmetry can be achieved by, for example, forming the side of the fixed face 23 connected to the second leg 20*b* with less material than the side connected to the first let 20*a*. In addition, the top shoulder 28 of the second leg 20*b* can be of lesser extent in the y-direction than the top shoulder of the first leg 20*a*. However, it is noted that the fixed contact carrier 20 can be configured with symmetry about its center plane while still allowing adequate clearance of the arc runner 35 along its side surface 27.

The separately described components of the fixed contact carrier 20 and the moveable contact carrier 30 can each be integrally formed as one piece of conductive material suitable for conductively conveying electrical energy (e.g., copper, iron, aluminum, steel, conductive plastics, etc.), or can be pieced together from separately formed components via secure electrical couplings such as those formed by welding, soldering, riveting, etc.

Referring to both FIGS. 3A and 3B, the arc runner 35 extends from the body of the moveable contact carrier 30 to a distal end 36 and includes a top side 38 and a bottom side 39. The arc runner 35 is integrally formed with the body of the moveable contact carrier 30 and co-planar with the body of the moveable contact carrier 30. However, aspects of the present disclosure provide for the arc runner 35 to be a separately formed component that is securely attached to the moveable contact carrier 30 such as by welding, soldering, etc. The arc runner 35 extends from the moveable contact carrier 30 toward the fixed contact carrier 20, such that a distal end 36 of the arc runner 35 extends beyond an imaginary projection ("virtual projection") of the side surface 27 of the fixed face 23 in a direction normal to the side surface 27. With reference to the coordinate vectors in FIGS. 3A and 3B, while the arc runner 35 has some thickness in the z-axis dimension, the arc runner 35 is generally constant in the z-axis direction (i.e., the axis of rotation of the moveable contact carrier 30).

The arc runner 35 extends in the direction of the x-axis and the y-axis, but lacks any significant dimensional component along the z-axis. The lack of a significant z-axis component allows the arc runner 35 to pass adjacent to the side surface 27 of the fixed contact carrier 20 without mechanical interference with components of the fixed contact carrier 20 or other components with the circuit breaker 20. However, implementations of the present disclosure can be realized while the arc runner 35 includes a z-axis component. For example, the arc runner 35 can be modified to include a bend or curve along its top edge to angle the top portion of the arc runner 35 nearest the top side 38 in either the positive z-direction (bent toward the fixed contact carrier 20) or the negative z-direction (bent away from the fixed contact carrier 20). Any such z-axis component of the arc runner 35 desirably avoids a mechanical interference with other components of the circuit breaker 10 while the moveable contact carrier 30 rotates between the closed position and the open position. A bend in the arc-runner to provide the arc runner 35 with some z-axis component can increase the structural integrity of the arc runner 35 to allow the arc discharge surface 37 to remain generally co-planar with the body of the moveable contact carrier 30 after repeated opening and closing operations of the moveable contact carrier. Increased structural integrity of the arc runner 35 can also allow the arc discharge surface 37 of the arc runner 35 to maintain as constant a discharge distance between the side surface 27 and the arc discharge surface 37 while the moveable contact carrier 30 is initially urged from the closed position to the open position.

The arc runner 35 is illustrated with a roughly constant height between the top side 38 and the bottom side 39 along the length of the arc runner 35 extending to the distal end 36. However, in implementations of the arc runner 35, the arc runner 35 can have a variable height which is lesser at the distal end 36 than at the interface with the body of the moveable contact carrier 30. For example, the top side 38 can be a portion of a plane intersecting the plane of the bottom side 39 in a line along the z-axis at a location beyond the distal end 36 of the arc runner 35, such that the height of the arc runner 35 gradually descends from the portion nearest the body of the moveable contact carrier 30 to the distal end 36. In some implementations, the height (e.g., the y-axis dimensional component) is advantageously maintained along the length (e.g., the x-axis dimensional component) of the arc discharge surface 37 according to the interface of an imaginary outwardly normal imaginary projection of the side surface 27 with the arc discharge surface 37. For example, the dimensions of the arc runner 35 can be selected such that the side surface 27 is substantially projected on to the arc discharge surface 37 even while the moveable contact carrier 30 is positioned such that an edge of the outwardly normal imaginary projection of the side surface 27 abuts the distal end 36 of the arc runner 35.

FIG. 3C (rear view) and FIG. 3D (front view) each illustrate the discharge distance between the side surface 27 and the arc discharge surface 37. Due to the configuration of the arc runner 35, the discharge distance is instantaneously maintained by at least a portion of the arc discharge surface 37 and the side surface 27 during an initial portion of the separation of the moveable contact 31 from the fixed contact 21. The distal end 36 of the arc runner 35 extending beyond the side surface 27 of the fixed contact carrier 30 while in the closed position allows the discharge distance to be maintained while the contacts 21, 31 are separated. As explained further below with reference to FIGS. 5A through 6, the smaller the discharge distance is in a particular implementation, the sooner the electrical arc is transferred from the contacts 21, 31 to the arc discharge surface 37, thereby preventing the degradation of the contacts 21, 31. However, the discharge distance is desirably large enough that the arc runner 35 can be repeatedly urged from the closed position to the open position without mechanically interfering with the fixed contact carrier 20 or with other components of the circuit breaker 10. Thus, the discharge distance is selected to be as small as practicable for a particular implementation without impeding the free movement of the moveable contact carrier 30 during repeated openings and closings of the contacts 21, 31.

Figure 4:
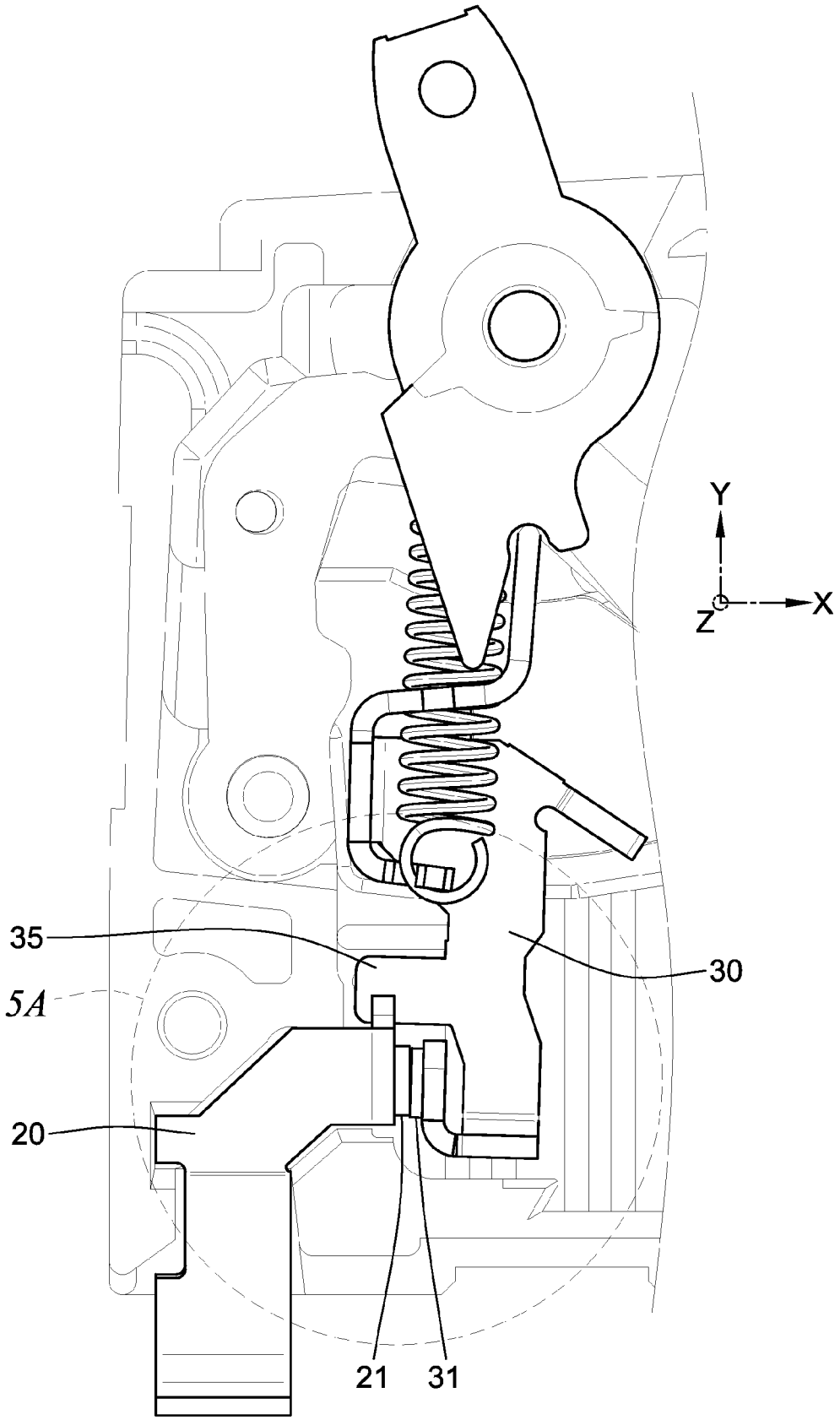
FIG. 4 illustrates an excerpted enlarged side view of FIG. 2A showing the handle, the moveable contact carrier, and the fixed contact carrier of the circuit breaker.

FIG. 4 illustrates an excerpted enlarged side view of FIG. 2A showing the handle 40, the moveable contact carrier 30, and the fixed contact carrier 20 of the circuit breaker 10.

Figure 5B:
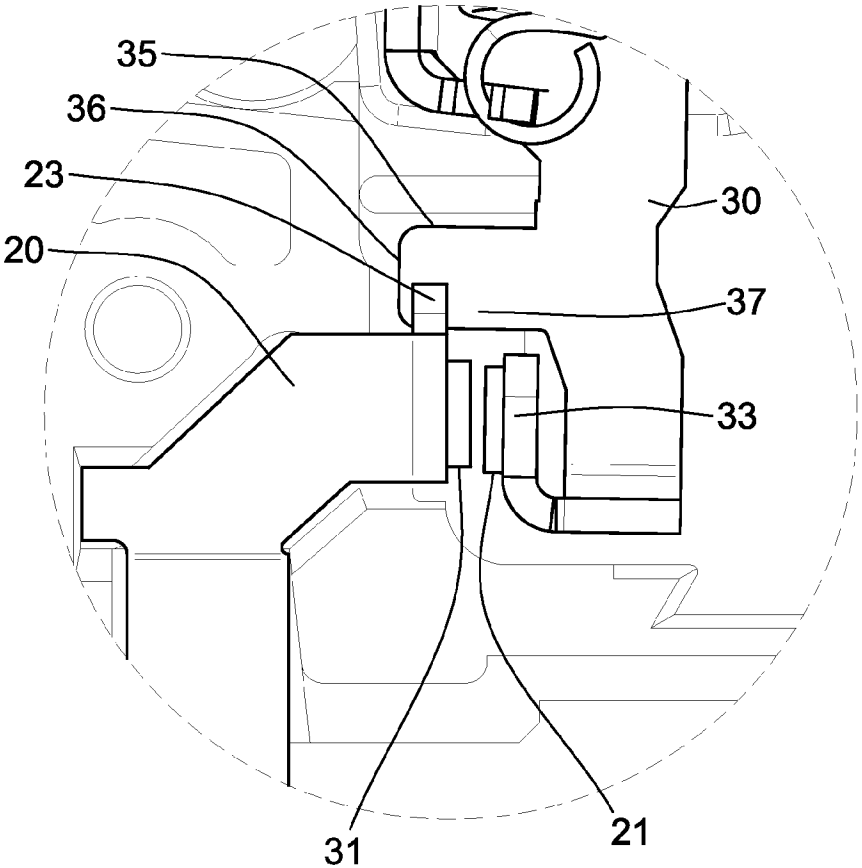
FIG. 5B illustrates a view similar to FIG. 5A, but after the moveable contact is initially separated from the fixed contact via the moveable contact carrier.
Figure 5A:
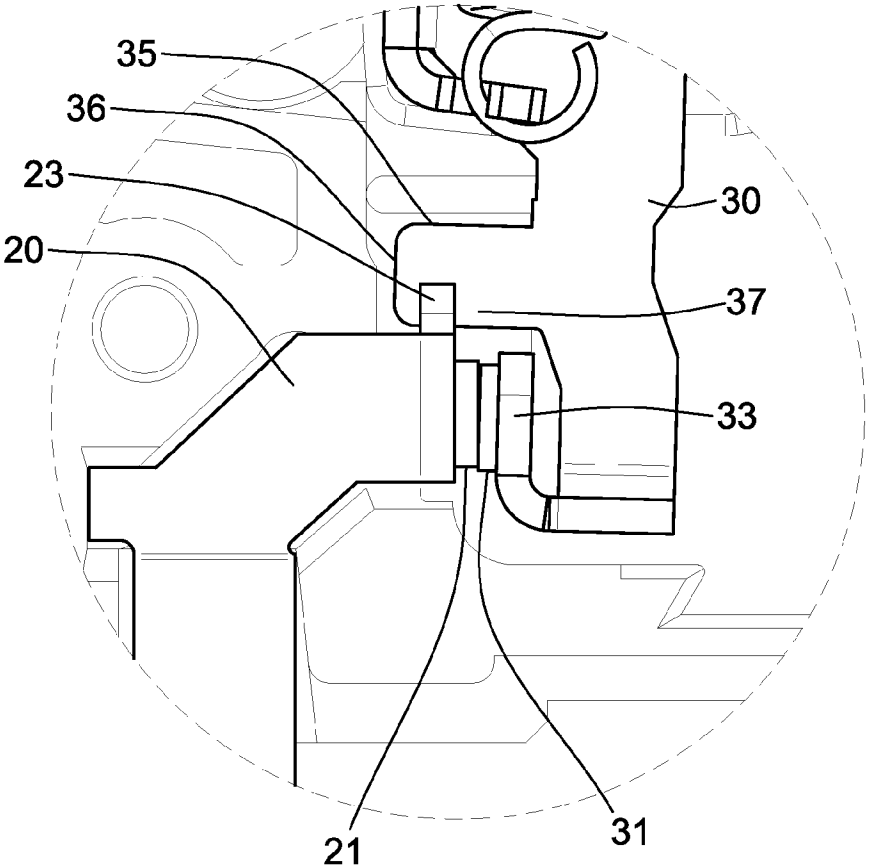
FIG. 5A is an excerpt of FIG. 4 showing the moveable contact carrier in the closed position such that the moveable contact abuts the fixed contact.

FIG. 5A is an excerpt of FIG. 4 showing the moveable contact carrier 30 in the closed position such that the moveable contact 31 abuts the fixed contact 21. FIG. 5B illustrates a view similar to FIG. 5A, but after the moveable contact 31 is initially separated from the fixed contact 21 via the moveable contact carrier 30. In the closed position, the distal end 36 of the arc runner 35 overlaps the side surface 27 of the fixed face 23. With reference to the coordinate unit vectors on FIG. 4, which displays the same configuration as the excerpted portion in FIG. 5A, the arc runner 35 overlaps the side surface 27 because the distal end 36 is at a lesser x-axis coordinate value than the lowest x-axis value of any portion of the side surface 27.

As the moveable contact carrier 30 is urged away from the fixed contact carrier 20, an initial portion of which is illustrated by FIG. 5B, an outwardly normal imaginary projection of the side surface 27 traces out a portion of the arc discharge surface 37 as the arc discharge surface 37 sweeps past the side surface. The portion of the arc discharge surface 37 that is traced by the outwardly normal imaginary projection of the side surface 27 is the portion that instantaneously maintains the constant discharge distance between the side surface 27 and the arc discharge surface 37. For example, the distance between the side surface 27 is separated from a portion of the arc discharge surface 37 by the discharge distance while the moveable contact carrier 30 is in the closed position (FIG. 5A). While the moveable contact carrier 30 is initially separating from the fixed contact carrier 20 (FIG. 5B), the side surface 27 is separated from a slightly different (e.g., shifted) portion of the arc discharge surface 37 by the same discharge distance. By contrast, while the distance between the side surface 27 and the arc discharge surface 37 remains constant at the discharge distance, the distance between the contacts 21, 31 steadily increases as the moveable contact carrier 30 rotates. After the distance between the contacts 21, 31 exceeds the discharge distance, the electrical arc generally transfers to the space between the side surface 27 and the arc discharge surface 37 because arcs are more readily formed over smaller air gaps.

Figure 6:
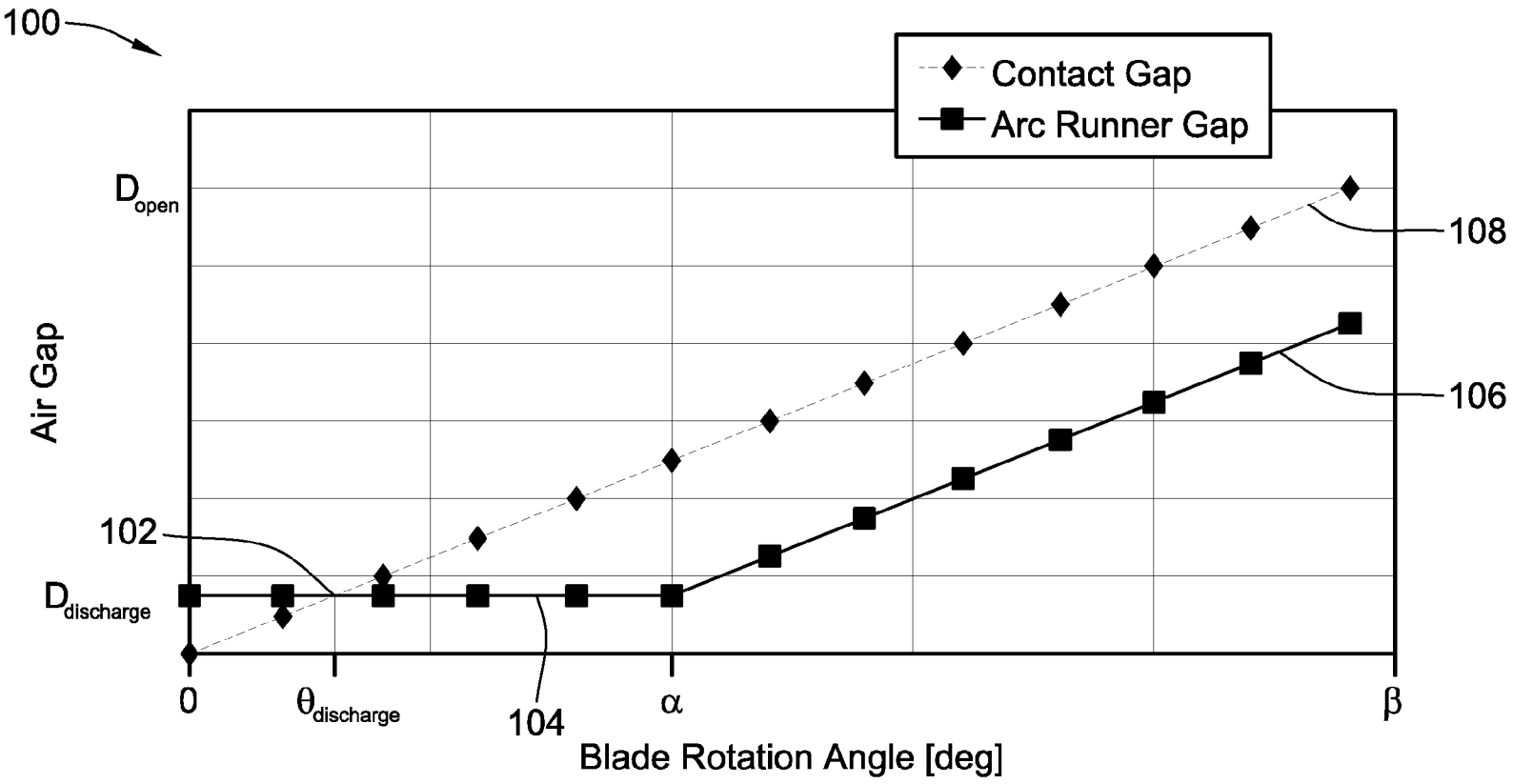
FIG. 6 illustrates a graph showing the separation between the contacts and the separation between the side surface and the arc discharge surface for an example implementation according to the present disclosure.

FIG. 6 illustrates a graph 100 showing the separation between the contacts 21, 31 and the separation between the side surface 27 and the arc discharge surface 37 for an example implementation according to the present disclosure. The vertical axis of the graph 100 indicates the respective separations distances while the horizontal axis of the graph 100 indicates the amount of counter-clockwise rotation of the moveable contact carrier 30 relative to the closed position. The separation between the contacts 21, 31 are indicated by diamonds, while the separation between the side surface 27 and the arc discharge surface 37 are indicated by squares. The trend line 108 describes the separation of the contacts 21, 31 at angles of rotation of the moveable contact carrier 30 ranging from 0 degrees to $\beta$ degrees. As shown in the graph 100, at 0 degrees of rotation, the contacts 21, 31 touch and are not separated (i.e., a separation of 0), but at an angle of $\beta$ degrees, which corresponds to the position of the moveable contact carrier 30 in the open position, the contacts 21, 31 are separated by an open distance ("Dopen"). For example, the open distance Dopen can be approximately 0.4 inches. In implementations, the angle of rotation of the moveable contact carrier 30 in the open position (i.e., the angle $\beta$) can be, for example, 25 degrees.

The separation of the arc discharge surface 37 from the side surface 27 is described by a trend line having an unchanging portion 104 and an increasing portion 106. The unchanging portion 104 corresponds to an initial portion of the rotation of the moveable contact carrier 30 (e.g., 0 degrees to $\alpha$ degrees) where the distance between the side surface 27 and the arc discharge surface 37 remains constant at the discharge distance ("Ddischarge"). The discharge distance Ddischarge is maintained during the initial portion because at least a portion of the arc discharge surface 37 is instantaneously separated from the side surface 27 by the discharge distance as the arc runner 35 sweeps past the side surface 27 during the initial portion.

The graph 100 also illustrates a point of intersection 102 where the two separations are equal. The point of intersection 102 corresponds to the point during a rotational separation of the moveable contact carrier 30 when the distance between the contacts 21, 31 equals the distance between the arc discharge surface 37 and the side surface 27. Generally, an electrical arc generated during the rotational separation will transfer from the contacts 21, 31 to the arc discharge surface 37 after the rotational separation exceeds the rotational separation corresponding to the point of intersection 102 (e.g., the angle indicated as θdischarge, which can be, for example, approximately 3 degrees). As described above, and illustrated by the chart 100, the smaller the discharge distance Ddischarge the sooner the electrical arc will transfer off of the contacts 21, 31, thereby preventing the degradation of the contacts 21, 31.

Preliminary laboratory tests have revealed that implementations of the circuit breaker 10 incorporating the arc runner 35 can dramatically reduce the electrical arc energy applied to the contacts 21, 31 during repeated switching operations. For example, cumulative energy on the contacts 21, 31 due to electrical arcs after 3000 opening and closing operations of the handle can be reduced by a factor of ten or more (e.g., from 24000 J to 1500 J). Thus, the arc runner 35 does not allow the electrical arc to flow toward the toggle spring 54 or other nearby components of the tripping mechanism. Moreover, the arc runner 35 serves to protect the fixed contact carrier 20 and moveable contact carrier 30 from damage such as erosion which can be caused by the electrical arc by minimizing their exposure to the electrical arc.

In an example implementation, the arc runner 35 is composed of a conductive material such as steel, iron, copper, or conductive plastics. The thickness of the arc runner 35 is approximately 0.04 inches, which is approximately the same as the thickness of the body of the moveable contact carrier 30. The length of the arc runner 35 (the distance between the distal end 36 and the interface with the body of the moveable contact carrier 30) is approximately 0.4 inches, while the height of the arc runner 35 (the distance between the top side 38 and the bottom side 39) is approximately 0.16 inches. However, implementations of the arc runner 35 can be realized with varying physical dimensions while providing a constant discharge distance to a side surface during an initial separation of contacts such that an electrical arc between the contacts is transferred to the arc runner.

The arc runner 35 is illustrated herein as coupled to the moveable contact carrier 30, but implementations of the present disclosure are not so limited. For example, an arc runner can be integrally formed with, or otherwise securely conductively coupled to, the fixed contact carrier 20, while a suitable side surface can be provided on the moveable contact carrier 30. In such implementations, the arc runner includes an arc discharge surface oriented perpendicular to an axis of rotation of the moveable contact carrier 30. Furthermore, the arc runner on the fixed contact carrier 20 is allowed to overlap the side surface (or other suitable conductive feature) on the moveable contact carrier 30 such that a constant discharge distance is maintained from the arc discharge surface during an initial portion of a separation of the moveable contact carrier from the fixed contact carrier.

The fixed contact carrier 20 is illustrated and described herein as a jaw type fixed contact carrier that includes the inwardly biased legs 20*a*, 20*b* for electrically coupling to a conductive feature such as a bus bar. However, the present disclosure is not so limited and includes implementations having various forms of fixed contact carriers including fixed contact carriers that lack inwardly biased legs. For example, the fixed contact carrier can be a bolt-on type fixed contact carrier. Bolt-on fixed contact carriers can be configured with a face generally similar to the fixed face 23 (e.g., FIG. 3B), which provides a mounting point for a fixed contact. The face can also have a conductive feature along its side which can be similar to, for example, the side surface 27 (e.g., FIG. 3B). Bolt-on fixed contact carriers can have a conductive strap extending outside of the housing of the circuit breaker. The strap can include a hole through the strap for a bolt (or similar fastener) to pass through to a threaded portion of a conductive feature. Such bolt-on type configurations (or other configurations of the fixed and/or moveable contact carriers) desirably incorporate an arc runner securely coupled to the fixed or moveable contact carrier, which maintains a substantially constant distance from a side feature of the other contact carrier during an initial portion of a separation of the contacts mounted thereon.

Aspects of the present disclosure allow for preventing the degradation of contacts in a circuit breaker or other switching device which includes contacts that are repeatedly separated while energized. As previously described, the separation of energized contacts leads to electrical arcs between the contacts that degrades the conductive contacts over time to gradually increase their resistance and their efficiency in conductively conveying electrical energy. By preventing the degradation of the contacts, aspects of the present disclosure allow for the contacts to be constructed of less expensive materials (e.g., less silver) or to extend the useful operating life of the circuit breaker (or other switching device), or both. For example, switching devices incorporating an arc runner according to the present disclosure which allows for a discharge distance between the arc runner and a feature of the other contact to be maintained as constant while the contacts separate beyond the discharge distance can withstand as many as 3000 switching operations while still maintaining desired operating performance (such as according to standards established by UL).

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

What is claimed is:

1. An electrical circuit protection device comprising:

a first contact coupled to a first contact carrier;

a second contact coupled to a second contact carrier, the second contact configured to abut the first contact in a closed position of the electrical circuit protection device;

a tripping mechanism coupled to the first contact carrier or the second contact carrier, the tripping mechanism configured to cause the first contact and the second contact to separate in response to an occurrence of a fault condition; and an arc runner electrically coupled to one of the first contact carrier and the second contact carrier, the arc runner situated with an arc discharge surface of the arc runner separated from a side surface of the other of the first contact carrier and the second contact carrier by a discharge distance in the closed position of the electrical circuit protection device, the discharge distance between the side surface and the arc discharge surface being substantially maintained during an initial separation of the first contact and the second contact while a distance between the first contact and the second contact exceeds the discharge distance, wherein the arc discharge surface of the arc runner is separated from the side surface from the closed position to an open position of the electrical circuit protection device.

2. The electrical circuit protection device according to claim 1, wherein one of the first contact or the second contact is configured to rotationally separate from the other, the one of the first contact or the second contact rotating, during the rotational separation, about a z-axis, the z-axis being perpendicular to an x-axis and a y-axis, the x-axis and the y-axis being mutually perpendicular, the arc runner comprising a conductive surface having a dimension along both the x-axis and the y-axis, but being substantially constant along the z-axis.

3. The electrical circuit protection device according to claim 2, wherein the arc runner lacks a significant z-axis dimensional component.

4. The electrical circuit protection device according to claim 1, wherein the electrical circuit protection device is configured to divert an electrical arc from between the first contact and the second contact to between the arc discharge surface and the side surface responsive to the distance between the first contact and the second contact exceeding the discharge distance.

5. The electrical circuit protection device according to claim 1, further comprising a handle for manually separating the first contact from the second contact, the handle providing a mechanical coupling to a moveable one of the first contact carrier or the second contact carrier such that the contact of the moveable one rotationally separates from the contact of the other responsive to the handle being urged from an on position to an off position.

6. The electrical circuit protection device according to claim 1, wherein the arc discharge surface and the side surface are co-aligned along substantially parallel planes.

7. The electrical circuit protection device according to claim 1, wherein the second contact carrier is a moveable contact carrier configured to be rotated such that the second contact is separated from the first contact in an open position of the electrical circuit protection device, the arc runner being coupled to the second contact carrier.

8. An electrical switching device comprising:

a first contact for electrically coupling to a supply of electrical energy, the first contact being mounted to a fixed contact carrier;

a second contact for conveying the electrical energy to a terminal of the electrical switching device, the second contact being mounted to a moveable contact carrier, the second contact being configured to abut the first contact in a closed position of the electrical switching device; and an arc runner extending from one of the fixed contact carrier or the movable contact carrier, an arc discharge surface of the arc runner aligned to maintain a substantially constant discharge distance from a feature of the other of the fixed contact carrier or the movable contact carrier during an initial separation of the first contact and the second contact, wherein the arc discharge surface of the arc runner is separated from the feature from the closed position to an open position of the electrical circuit protection device.

9. The electrical switching device according to claim 8, further comprising a handle for manually separating the second contact from the first contact, the handle providing a mechanical coupling to the moveable contact carrier such that the second contact rotationally separates from the first contact responsive to the handle being adjusted from an on position to an off position.

10. The electrical switching device according to claim 9, wherein the arc runner is configured such that a distal end of the arc runner extends beyond the feature of the other of the fixed contact carrier or the moveable contact carrier while the electrical switching device is in the closed position, at least a portion of the arc discharge surface instantaneously maintaining the discharge distance as the arc runner moves relative to the feature during an initial portion of the rotational separation of the moveable contact carrier while a distance between the first contact and the second contact exceeds the discharge distance.

11. The electrical switching device according to claim 8, wherein the electrical switching device is configured to divert an electrical arc from between the first contact and the second contact to between the arc discharge surface and the feature responsive to the distance between the first contact and the second contact exceeding the discharge distance.

12. The electrical switching device according to claim 8, wherein the second contact is configured to rotationally separate from the first contact, the second contact rotating, during the rotational separation, about a z-axis, the z-axis being perpendicular to an x-axis and a y-axis, the x-axis and the y-axis being mutually perpendicular, the arc runner comprising a conductive surface having a dimension along both the x-axis and the y-axis, but being substantially constant along the z-axis.

13. The electrical switching device according to claim 8, wherein the feature is a side surface of the other of the fixed contact carrier or the second contact carrier, the side surface being perpendicular to a plane defined by the interface of the abutted first contact and second contact in the closed position of the electrical switching device.

14. The electrical switching device according to claim 8, wherein the arc runner extends from the moveable contact carrier and the feature is a side surface of the fixed contact carrier.

15. The electrical switching device according to claim 8, wherein the feature is a substantially flat surface along a side of the other of the fixed contact carrier or the moveable contact carrier, and wherein the arc discharge surface is a substantially flat surface substantially parallel to the substantially flat surface of the feature.

16. The electrical switching device according to claim 15, wherein the substantially parallel surfaces are each perpendicular to an axis of rotation of the moveable contact carrier.

17. An electrical switching device comprising:

a first contact for electrically coupling to a supply of electrical energy, the first contact being mounted to a fixed contact carrier;

a second contact for conveying the electrical energy to a terminal of the electrical switching device, the second contact being mounted to a moveable contact carrier, the second contact being configured to abut the first contact in a closed position of the electrical switching device;

a handle for rotating the moveable contact carrier to an open position of the electrical switching device, the first contact and the second contact being separated while in the open position; and an arc runner coupled to the moveable contact carrier and aligned such that an arc discharge surface of the arc runner maintains a discharge distance from a side surface of the fixed contact carrier during an initial portion of the rotation of the moveable contact carrier to the open position while a distance between the first contact and the second contact exceeds the discharge distance, the arc discharge surface and the side surface being substantially parallel surfaces and each substantially perpendicular to an axis of rotation of the moveable contact carrier.

18. The electrical switching device according to claim 17, wherein the axis of rotation of the moveable contact carrier is perpendicular to an x-axis and a y-axis, the x- axis and the y-axis being mutually perpendicular, the arc runner comprising a conductive surface having a dimension along both the x-axis and the y-axis, but lacking a significant dimensional component along the axis of rotation.

19. The electrical switching device according to claim 17, wherein the arc runner is configured such that a distal end of the arc runner extends beyond the side surface while the electrical switching device is in the closed position, at least a portion of the arc discharge surface instantaneously maintaining the discharge distance as the arc runner moves relative to the side surface during an initial portion of the rotational separation of the moveable contact carrier while a distance between the first contact and the second contact exceeds the discharge distance.

* * * * *